United States Patent [19]

Taylor et al.

[11] Patent Number: 4,903,180

[45] Date of Patent: Feb. 20, 1990

[54] LUMINAIRE WITH PROTECTED PRISMATIC REFLECTOR

[75] Inventors: C. David Taylor, Hendersonville; J. Bradley Pearce, Horse Shoe; Mitchell M. Osteen, Zirconia, all of N.C.

[73] Assignee: General Electric Company, Schenectady, N.Y.

[21] Appl. No.: 281,117

[22] Filed: Dec. 7, 1988

[51] Int. Cl.[4] ..... F21V 5/02; F21V 15/00; F21V 29/00

[52] U.S. Cl. ..... 362/337; 362/340; 362/373; 362/376

[58] Field of Search ..... 362/294, 337, 339, 340, 362/373, 376, 378, 348

[56] References Cited

U.S. PATENT DOCUMENTS

| | | | |
|---|---|---|---|
| 1,259,493 | 3/1918 | Dorey | 362/337 |
| 1,612,804 | 1/1927 | Dorey | 362/337 |
| 1,758,977 | 5/1930 | Rolph | 362/337 |
| 2,818,500 | 12/1957 | Franck | 362/337 |
| 3,609,348 | 9/1971 | Marasco et al. | 362/378 X |
| 4,160,286 | 7/1979 | Merritt | 362/376 X |
| 4,180,851 | 12/1979 | Ericson, Jr. | 362/378 |
| 4,439,816 | 3/1984 | Litchfield | 362/373 X |
| 4,460,945 | 7/1984 | Chan et al. | 362/373 X |
| 4,658,339 | 4/1987 | Tammery et al. | 362/373 X |

OTHER PUBLICATIONS

Brochure entitled Holophane Prismalume Luminaires, No. HL-755 1-84 by Manville Corp., Holophane Division, 4 pages; date printed on brochure: 1-84.

Brochure entitled Holophane Prismpack II and Warehouse Prismpack II Reflector Series, No. HL-427 by Manville Corp., Holophane Division, cover page, pp.2 and 3, date printed on brochure: 1-84.

*Primary Examiner*—Ira S. Lazarus
*Assistant Examiner*—Peggy A. Neils
*Attorney, Agent, or Firm*—John P. McMahon; Stanley C. Corwin; Fred Jacob

[57] ABSTRACT

This luminaire comprises a reflector of transparent material having a prismatic outer surface that includes many juxtaposed prisms. Each prism includes two reflecting surfaces meeting at an apex and having portions disposed to effect total internal reflection of a large percentage of the light rays from the light source of the luminaire. Immediately adjacent the outer surface of the reflector, there is a cover of substantially transparent material that protects the prism reflecting surfaces from deposits that could interfere with their total internal reflecting properties. The cover is spaced from the prismatic outer surface at substantially all points on the prism reflecting surfaces where such reflecting surfaces are disposed to effect total internal reflection of the light source rays.

11 Claims, 3 Drawing Sheets

LUMINAIRE WITH PROTECTED PRISMATIC REFLECTOR

This invention relates to a luminaire and, more particularly, to a luminaire of the type in which there is provided about a light source a reflector of transparent material having a prismatic outer surface comprising prisms with reflecting surfaces oriented to effect total internal reflection of light from the light source.

BACKGROUND

Luminaires that rely upon prismatic reflectors of the above type are conventional and are disclosed in the following exemplary U.S. Pat. Nos. 2,818,500—Franck; 1,259, 493—Dorey; and 1,758,977—Rolph. These prismatic reflectors rely upon the principle of total internal reflection of visible light at a glass-to-air interface when the light is incident upon that surface at an angle greater than the critical angle of incidence, which for a glass-to-air interface is typically about 42°. Typically, each prism has two reflecting surfaces, one of which reflects light onto the other, and each being oriented to provide an incidence angle of greater than the critical angle with respect to the light incident thereon. The reflecting surfaces of each of these prisms meet at an apex, and the adjacent reflecting surfaces of juxtaposed prisms meet in a valley between the prisms at the nadir of the valley.

A disadvantage of this type of reflector is that if a non-uniform film is allowed to deposit on the prismatic surface, the desired reflecting properties of the surface may be significantly degraded, especially if the film is partially or fully light-absorbing. If the deposit is not uniform, it effectively changes the incidence angle of light rays striking the relevant interface of the prism with the adjacent air and may let light through this first interface or may change the angle of reflection so much at the first interface that the incidence angle at the second interface is less than the required critical angle, thereby letting the light pass through at the second interface.

Another characteristic of prismatic reflectors of the above type is that a substantial amount of light will pass through the reflector even though the reflecting surfaces of the prisms are clean. One reason for this is that the molds typically used for making the prismatic reflectors are not precise enough to achieve mathematical precision of the reflecting surfaces all the way to the apices of the prisms and to the nadir of the valleys between them; and, consequently, light leakage will occur in these regions. Additional light leakage can occur at points of defects in the prism surfaces, which points may be present as a result of mold imperfections or even designed-in defects. Altogether, this light leakage can typically amount to about 25% of the lumen output of the luminaire. In certain luminaire applications, specifically, those with bare reflectors, this light leakage has been advantageously employed to provide uplight, so as to reduce ceiling contrast and to illuminate overhead structures.

To protect the optical properties of the prismatic surface of the reflector from being degraded by the deposition thereon of film or other contaminants, the reflector has sometimes been provided with a form-fitting metal cover, surrounding the reflector and spaced a small distance from its outer surface. A disadvantage of this construction is that the metal cover defeats the often-desired uplighting abilities of the luminaire.

OBJECTS

An object of our invention is to provide, for a luminaire of the type that comprises a reflector of transparent material having total internal reflecting prisms on its outer surface, cover means that is capable of protecting these prisms against surface depositions but yet will not significantly interfere with the desired uplighting abilities of the luminaire.

Another object to is provide cover means capable of performing as in the immediately-preceding object, yet without significantly interfering with the total internal reflecting properties of the prisms on the outer surface of the reflector.

Another object is to construct the luminaire in such a manner that a clean environment is maintained between the prismatic outer surface of the reflector and the cover means.

SUMMARY

In carrying out the invention in one form, we provide a luminaire that comprises a reflector of transparent material and means for mounting a light source within the reflector. The reflector has a prismatic outer surface that has many prisms located at juxtaposed spaced locations along the outer surface. The prisms are characterized by reflecting surfaces that are disposed so that a large percentage of the rays from the source strike the reflecting surfaces at angles of incidence greater than the critical angle of incidence, thereby totally internally reflecting a large percentage of the light from the source. In combination with this reflector, we provide a cover of substantially transparent material located externally of the reflector and of a shape generally conforming to that of the reflector. Means is provided for mounting the transparent cover closely adjacent the prismatic outer surface of the reflector in such a manner that the cover is spaced from the prismatic outer surface at substantially all points on the prisms reflecting surfaces where the prism reflecting surfaces are disposed to effect total internal reflection of the light source rays.

BRIEF DESCRIPTION OF DRAWINGS

For a better understanding of the invention, reference may be had to the following detailed description, taken in conjunction with the accompanying drawings, wherein.

DETAILED DESCRIPTION OF ILLUSTRATED EMBODIMENT

Figure 1:
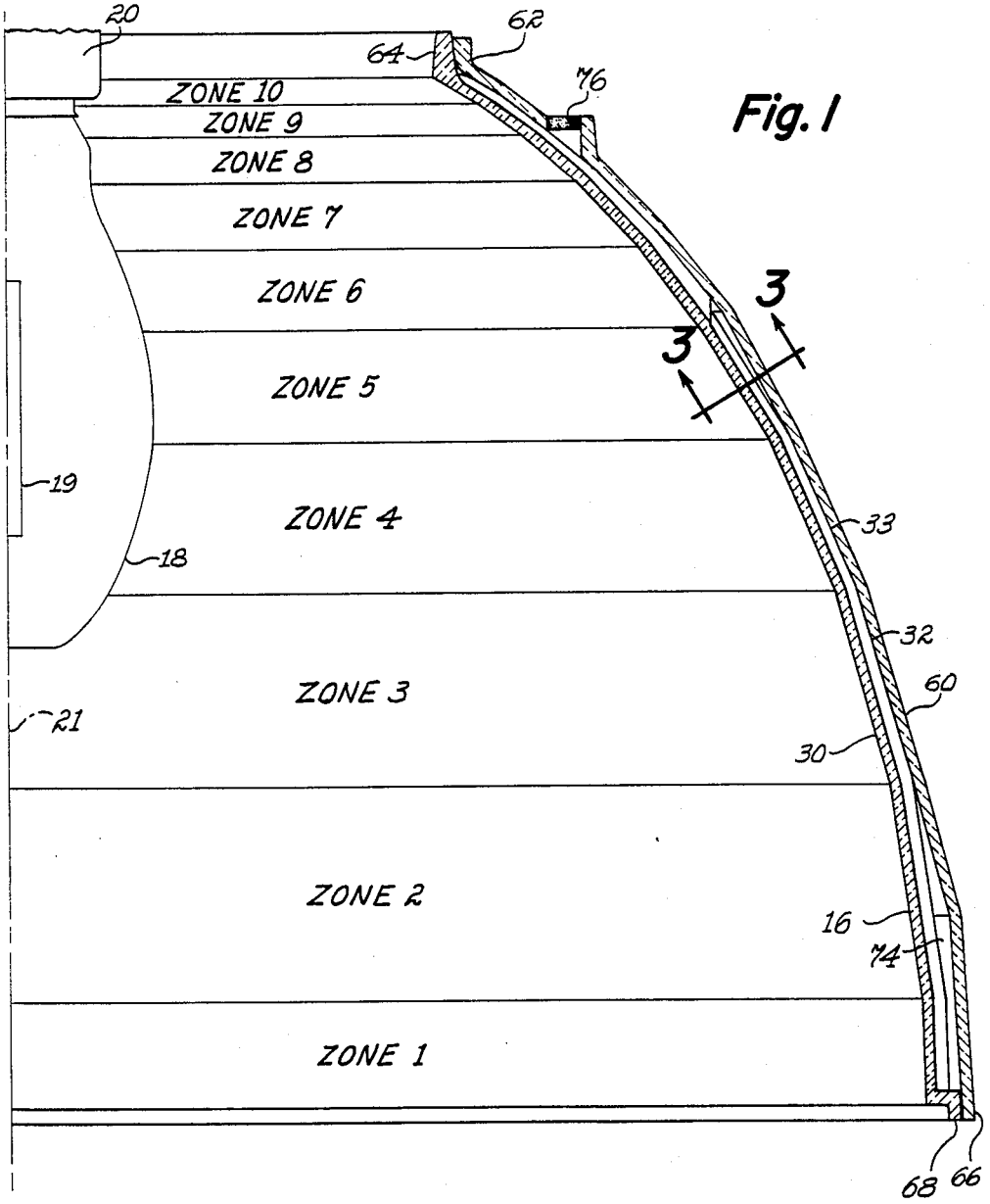
FIG. 1 is a sectional view of a portion of a luminaire embodying one form of our invention.
Figure 2:
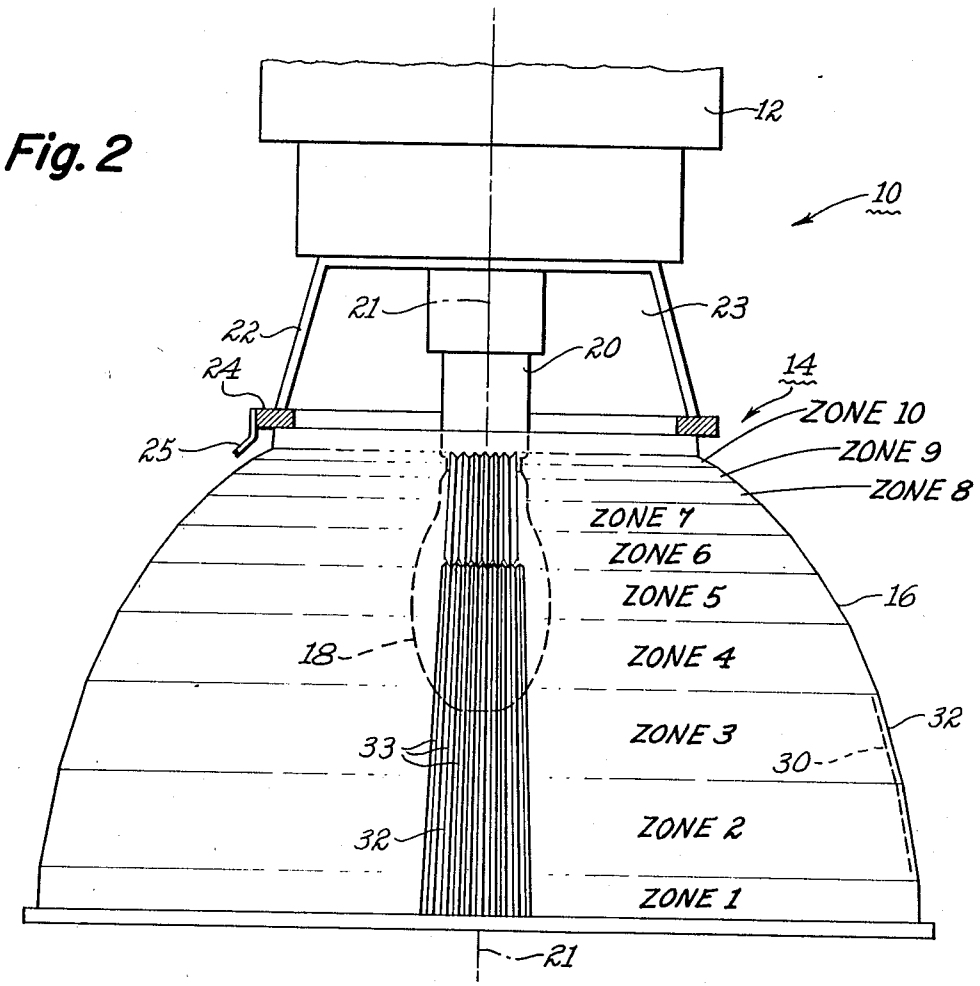
FIG. 2 is a side elevational view, partly schematic, of the luminaire of FIG. 1, with the dome-shaped reflector of FIG. 1 shown in full lines but with its cover removed.

Referring first to FIG. 2, there is shown an industrial luminaire 10 comprising a ballast housing 12 having suspended from the bottom thereof an optical assembly 14. The optical assembly comprises a dome-shaped reflector 16 of transparent material, such as a suitable glass or a suitable acrylic resin. Within the reflector 16 is mounted a lamp 18, typically of the gaseous discharge type, removably secured to a lamp holder or socket 20 so as to extend into the reflector along the central vertical axis 21 of the reflector. Referring to FIG. 1, the lamp is schematically illustrated as including an arc tube, or source, 19 on the central vertical axis 21. It is to be understood that the invention is also applicable to luminaires that include other types of light sources, for example, suitable incandescent lamps.

The reflector 16 (FIG. 2) is supported on the ballast housing 12 by yoke structure 22 that has large openings 23 therein to permit full ventilation of the reflector by chimney action. More specifically, air is able to flow upwardly through the open bottom of the reflector, then upwardly through the reflector through its upper end, and then through the openings 23 in the yoke 22. Additional support for the reflector 16 may be provided by three generally vertically-extending rods (one of which is partially shown at 25 in FIG. 2) which are located outside the reflector and are angularly spaced about the reflector periphery. These rods are attached at their lower ends to suitable radially-extending projections on an annular retaining ring (not shown) at the bottom of the reflector and at their upper ends to a ring 24 forming a part of yoke 22.

Referring to FIGS. 1 and 2, the dome-shaped reflector comprises a series of superimposed integrally-connected sections, each of a truncated conical form and each merging smoothly with the smaller diameter section immediately above it. Each truncated conical section tapers to a progressively greater extent than the one beneath it. The truncated conical sections are respectively located in superposed regions of the dome designated zones 1 through 10.

The dome-shaped reflector 16 has a smooth inner surface 30 and a prismatic outer surface 32. This outer surface comprises a large number of double-reflecting prisms 33 shown in the central portion of FIG. 1, each extending in a plane that includes the longitudinal axis of the reflector, or vertically when viewed from the edge of such a plane, as shown in FIG. 1.

Figure 3:
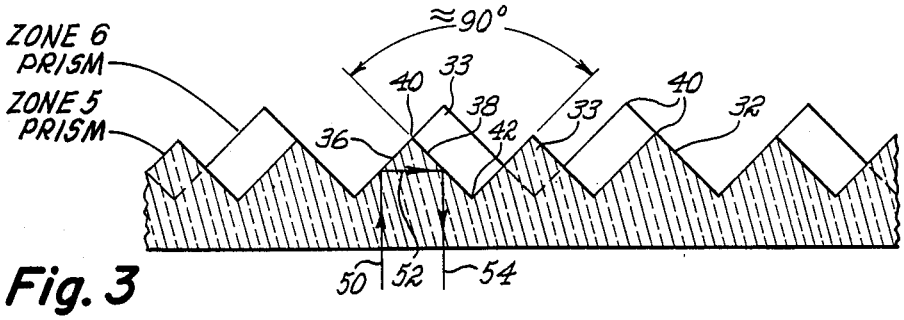
FIG. 3 is an enlarged sectional view along the line 3—3 of FIG. 1, but with the cover removed and with the depicted arcuate portion of the reflector unrolled.

In one embodiment of the invention, the reflector has a 25.2 inch outer diameter at its bottom and 360 juxtaposed external prisms 33 equally angularly spaced at one-degree intervals about the external periphery of the reflector in Zones 1 through 5. In Zones 6 and 7, there are 240 double reflecting external prisms of generally the same form equally spaced at 1.5 degree intervals about the outer periphery. The relationship of the prisms in Zone 5 as compared to Zone 6 is best shown in FIG. 3, where it can be seen that the prisms of Zone 6 (shown partially in phantom) project a slightly greater distance from the remainder of the external surface than is the case with the prisms in Zone 5. In Zones 8, 9 and 10, there are 240 prisms 33 equally spaced by 1.5 degrees about the outer periphery.

Referring to FIG. 3, each of the prisms 33 has two reflecting surfaces 36 and 38 that intersect at an apex 40. The reflecting surfaces 36 and 38 of immediately-adjacent prisms intersect at a valley nadir 42. To facilitate manufacture of the reflector, a small radius of curvature is present at each apex 40 and in each valley nadir 42. The reflector is preferable made by pressing or molding a suitable glass or acrylic compound (while hot and in a plastic or semiliquid state) into a concave mold having flutes in its active surface for forming the prisms, and it is not feasible to achieve great enough precision in the mold to produce intersection of the reflecting surfaces 36, 38 along perfect zero-width lines, hence the rounding that is present in these regions.

In the illustrated reflector, the reflecting surfaces 36 and 38 of the prisms are so oriented that most of the rays of light from the source are incidence to these surfaces at incidence angles greater than the critical angle of incidence, i.e., the minimum incidence angle at which total internal reflection occurs. A typical path for the light rays is illustrated in FIG. 3, where the ray 50 from the source is totally internally reflected off the surface 36 as a ray 52 which strikes the surface 38, where it is totally internally reflected as a ray 54. Total internal reflection occurs at a borosilicate glass-to-air interface when the incidence angle is greater than 42 degrees, assuming the glass has an index of refraction of about 1.5. For the acrylic compound, the critical angle of incidence is also about 42 degrees. In the illustrated prism, the incidence angles of the rays 50 and 52 at the surfaces 36 and 38 are each about 45 degrees. This relationship is achieved by making the angle between the juxtaposed prism reflecting surfaces about 90 degrees.

In a reflector with totally-reflecting external prisms oriented as illustrated, the reflector directs the rays internally reflected from the outer prismatic surface downwardly through the open end of the reflector via generally the same paths as would be followed by rays reflected off a smooth metal reflector of essentially the same shape and size as internal surface 30 of reflector 16.

While a major portion of the light striking the reflector is totally internally reflected, as above described, a substantial portion is not. Some of it passes through the reflector in the regions of the rounded apices 40 and valley nadirs 42, and some also passes through in regions where the prisms have surface defects, e.g., from imperfections in the molding apparatus or process. As will soon be described in more detail, we utilize this light leakage to produce uplight in the vicinity of the luminaire. In an industrial application, such uplight serves the desirable purpose of reducing ceiling contrast and illuminating nearby overhead structures.

To maintain the desired light output and distribution in the region beneath the luminaire, it is highly desirable that the reflecting surfaces 36 and 38 of the prisms be maintained free of non-uniform films and other deposits, especially if these deposits are partially or fully light-absorbing. If the deposit is not uniform, it effectively changes the incidence angle for the light rays impinging against the relevant interface at the deposit, and this may let light through this region of the reflector, or it may change the angle of reflection so much at the first interface (e.g., 36) that the incidence angle at the second interface (e.g., 38) is less than the required critical angle, thereby letting light pass through at this second interface. Such leakage detrimentally reduces the light output into the region beneath the luminaire.

To protect the reflecting surfaces 36 and 38 of the prisms 33 from such deposits, we surround the exterior prismatic surface 32 of the reflector with a form-fitting cover 60 of transparent material, such as a suitable plastic or glass. In the illustrated embodiment, this cover 60 is made by vacuum-forming clear sheet plastic around the prismatic reflector 16, sizing the cover so that it touches the prisms 33 only at their apices 40. The cover 60, at its upper end, is formed with a vertically-extending annular flange 62 that tightly surrounds a vertically-extending annular flange 64 at the top of the reflector 16 and integral with the reflector. Reflector flange 64 has a smooth circular external periphery to enhance the fit between it and the surrounding flange 62 of the cover. At its lower end, the cover 60 is formed with an annular portion 66 that tightly surrounds an annular flange 68 of the reflector, this flange 68 also having a smooth circular external periphery to enhance the fit between it and the cover portion (66) surrounding it. There are no external prisms on the reflector on the short flanges 64 and 68 at the extremities of the reflector.

Because the cover 60 completely surrounds the exterior surface of the reflector, it protects this exterior surface from the deposition thereon of films and other contaminants from the surrounding atmosphere. The protection provided by the cover 60 is enhanced by the relatively tight fit between the cover 60 and the reflector at the extreme end flanges 64 and 68 of the reflector. The tight fit in these regions impedes the entry of air from the surrounding atmosphere into the space 74 between the reflector 16 and the cover 60. This space 74 is not, however, sealed. It is allowed, in effect, to breathe in response to temperature changes of the reflector and the cover. Such breathing, for the most part, takes places through a low pressure-drop filter 76, which, in each of the illustrated embodiments, we locate in a passageway provided in the cover 60. The filter acts in a conventional manner to remove from the entering air most of the contaminants that could form deposits on the exterior surface of the reflector 16.

The above-described protection of the prismatic exterior surface 32 of the reflector 16 is obtained without significantly interfering with the desired uplighting abilities of the reflector inasmuch as the cover 60 is made of a transparent material. Light that leaks through reflector 16 is transmitted through the cover and can be effectively utilized to provide the desired uplight.

It is to be noted that the cover 60, although in contact with the reflector 16, does not significantly interfere with the internal reflecting properties of the reflector. This is made possible by the fact that the cover 60 contacts the prisms 60 only at their apices 40. Since light is already passing through the prismatic reflector at these locations, the reflector's internal reflecting properties remain essentially unchanged despite such contact at the apices.

Each reflecting surface 36 or 38 of each prism may be thought of as comprising an active reflecting portion and two edge portions at opposite edges of the active reflecting portion, one edge portion being located at the apex 40 of the prism and the other at the nadir 42 of the valley. The cover 60 is out of contact with the active reflecting portions of the prisms, touching the prisms only at their apices 40.

In one embodiment of the invention, the cover 60 is vacuum formed from a ⅛-inch thick sheet of clear acrylic resin. Other clear plastics can be utilized, but they must be capable of withstanding without damage the elevated temperatures produced by the light source during operation of the luminaire.

One way in which to carry out the vacuum-forming process is first to provide a heated mold (not shown) having a cavity of the same shape as the cover 60, but very slightly larger than the cover. Then a ⅛-inch thick easily-deformable sheet of the acrylic plastic is placed over the mouth of the mold cavity, following which a vacuum is established within the mold cavity behind the sheet, thus drawing the sheet into contact with the dome-shaped wall of the cavity. Then the reflector is inserted into the cavity so that it is closely surrounded by the formed sheet. Then the vacuum behind the sheet is removed and the sheet is allowed to cool, thus causing the formed sheet to shrink about the reflector.

Figure 4:
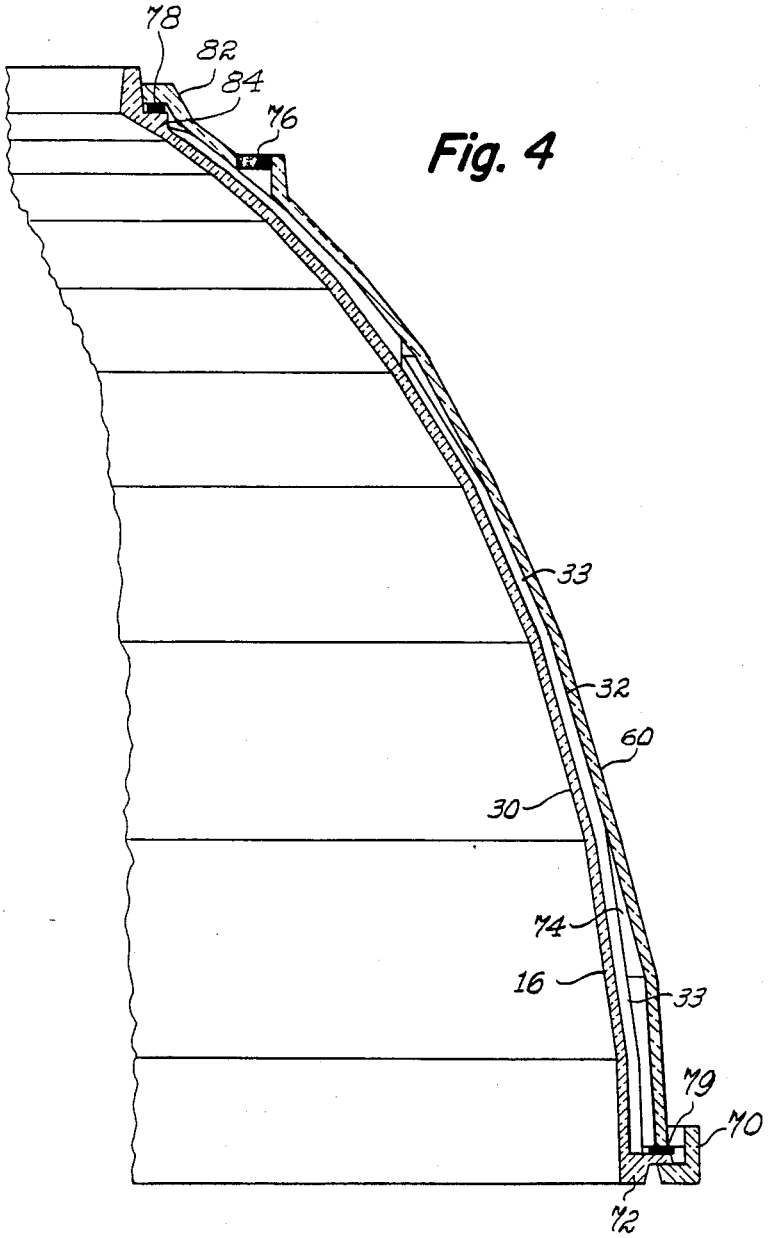
FIG. 4 is a sectional view similar to FIG. 1 of a portion of a luminaire embodying a modified form of the invention.

Another way of making the cover 60 of FIG. 1 or the modified cover 60 of FIG. 4 is by injection molding. Acrylic plastic, or some other suitable transparent plastic, is injected into a suitably shaped mold to form a cover of the size and shape shown in FIG. 1 or in FIG. 4. While the molded cover 60 is still hot, it is removed from the mold and pressed in place onto the reflector. Referring more specifically to the cover of FIG. 4, the cover is placed above the reflector with its axis coinciding with the axis 21 of the reflector and is then moved downwardly onto the reflector until angularly-spaced hook-shaped latches 70 at the lower end of the cover snap in place about a flange 72 at the lower end of the reflector. Annular gaskets 78 and 79 are provided at the top and bottom of the reflector to improve the joints in these regions. Gasket 79 fits between the bottom of the cover and the top of flange 72. Gasket 78 fits between a radial flange 82 at the top of the cover 60 and an annular region 84 on the reflector immediately beneath flange 82. When the cover cools, it shrinks about the reflector. Any contact with the prisms 33 is only at their apices 40, thus providing a fit similar to that present in FIGS. 1–3.

Despite the gaskets 78 and 79, the space 74 between the reflector 96 and the cover 60 is not totally sealed. As in the first embodiment, this space 74 is allowed to breathe in response to temperature changes. This breathing takes place through a low pressure-drop filter 76 in the same manner as described in connection with the first embodiment, thus maintaining the cleanliness of the entering air.

Whether made by vacuum forming or by injection molding, the resulting cover (60) is supported on the remainder of the luminaire in such a manner that it is maintained out of contact with the reflecting surfaces 36 and 38 of the prisms at substantially all points where these surfaces are oriented at incidence angles of greater than the critical incidence angle with respect to the incident light. Stated another way, the cover 60 is maintained out of contact with the active reflecting surface portions of the prisms. Accordingly, the active reflecting portions of reflecting surfaces 36 and 38 remain essentially unaffected by the presence of cover 60. While we permit contact between the cover and the reflector at the apices of the prisms 33, it is to be understood that the cover may instead by made slightly larger than shown to avoid most or all of such contact with the prisms.

While for most applications, we will use for the cover the most transparent material practicable for such use, a certain amount of translucence can be tolerated, or may even be desired, for some applications; and our invention in its broader aspects is therefore intended to comprehend a cover made from a material having some translucence. The term "substantially transparent material", as applied to the material of the cover, is used herein to comprehend material that transmits most of the light incident thereon.

While the reflector of the illustrated embodiment has a vertically oriented axis, it is to be understood that the invention in its broader aspects is applicable to luminaires in which the reflector is otherwise disposed, for example, with its axis inclined or even horizontal.

It is further noted that while the prisms 33 of the illustrated reflector 16 respectively extend in planes that include the central longitudinal axis 21 of the reflector, the invention in its broader aspects is also applicable to reflectors in which the prisms extend along paths that have somewhat different configurations, e.g., paths that have a slight helical component.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim is:

1. In a luminaire comprising a dome-shaped reflector of transparent material having a central longitudinal axis and means for mounting a light source substantially on said central axis, the reflector having a prismatic outer surface that has many prisms extending generally in planes that include said longitudinal axis and located at juxtaposed angularly spaced locations about the periphery of the reflector, the prisms having two reflecting surfaces that intersect at an apex with the apex being substantially a non-active reflective surface, the prisms being disposed so that a large percentage of the rays from said source strike said reflecting surfaces at angles of incidence greater than the critical angle of incidence, thereby totally reflecting a large percentage of the light from said source, the combination with said reflector of: (a) a cover of substantially transparent material of a shape generally conforming to the reflector shape and surrounding the reflector externally of said prismatic outer surface, and (b) means for mounting said transparent cover about said reflector in such a manner that said cover is spaced from said prismatic outer surface of the reflector at substantially all points on the prism active reflecting surfaces where said prism reflecting surfaces are disposed to effect total internal reflection of the light source rays, and wherein said transparent cover touches said prisms only at the apices thereof.

2. In a luminaire comprising a dome-shaped reflector of transparent material having a central longitudinal axis and means for mounting a light source substantially on said central axis, the reflector having a prismatic outer surface that has many prisms extending generally in planes that include said longitudinal axis and located at juxtaposed angularly spaced locations about the periphery of the reflector, the prisms being respectively characterized: (i) by having two reflecting surfaces that intersect at an apex with the apex being substantially a non-active reflective surface, (ii) by orientation of the two reflecting surfaces so that a large percentage of the rays from said source strike said reflecting surfaces at angles of incidence greater than the critical angle of incidence thereby totally reflecting a large percentage of the light from said source, and (iii) by each reflecting surface including an active reflecting portion and an edge portion located at the apex of the prism, the combination with said reflector of:

(a) a cover of substantially transparent material of a shape generally conforming to the reflector shape surrounding the reflector externally of said prismatic outer surface, and (b) means for mounting said transparent cover about said reflector in such a manner that said cover is out of contact with substantially all points on the active reflecting surfaces of said prisms, and wherein said transparent cover touches said prisms only at the apices thereof.

3. The combination of claim 2 in which said transparent cover covers substantially all the prisms on the prismatic outer surface of said reflector.

4. The combination of claim 2 in which there is a space between said cover and the outer surface of said reflector into which and out of which air flows in response to temperature changes of the reflector, and in which:

(a) filtering means is provided in passage means between said space and the surrounding atmosphere, and (b) flow restricting means is provided between said reflector and said cover to force most of the air entering said space from the surrounding atmosphere to flow through said filtering means.

5. The combination of claim 4 in which said flow restricting means is characterized by a tight fit between said cover and said reflector at the top and bottom of the reflector.

6. The combination of claim 4 in which said flow restricting means comprises gaskets between said cover and said reflector at the top and bottom of the reflector.

7. In a luminaire comprising a reflector of transparent material and means for mounting a light source within said reflector, the reflector having a prismatic outer surface that has many prisms located at juxtaposed spaced locations along said outer surface, the prisms having two reflective surfaces that intersect at an apex with the apex being substantially a non-active reflective surface, the prisms being disposed so that a large percentage of the rays from said source strike said reflecting surfaces at angles of incidence greater than the critical angle of incidence, thereby totally internally reflecting a large percentage of the light from said source, the combination with said reflector of:

(1) a cover of substantially transparent material for the reflector located externally of said prismatic outer surface and of a shape generally conforming to that of said reflector, and (b) means for mounting said transparent cover closely adjacent the prismatic outer surface of said reflector in such a manner that said cover is spaced from said prismatic outer surface at substantially all points on the prism active reflecting surfaces where said prism reflecting surfaces are disposed to effect total internal reflection of the light source rays, and wherein the reflecting surfaces of each prism meet at an apex and said transparent cover touches said prisms only at the apices thereof.

8. The combination of claim 7 in which said transparent cover covers substantially all the prisms on the prismatic outer surface of said reflector.

9. The combination of claim 7 in which there is a space between said cover and the outer surface of said reflector into which and out of which air flows in response to temperature changes of the reflector, and in which:

(a) filtering means is provided in passage means between said space and the surrounding atmosphere, and (b) flow restricting means is provided between said reflector and said cover to force most of the air entering said space from the surrounding atmosphere to flow through said filtering means.

10. The combination of claim 9 in which said flow restricting means is characterized by a close fit between said cover and said reflector along the margins of said cover.

11. The combination of claim 9 in which said flow restricting means comprises gasket structure between said cover and said reflector along the margins of said cover.

* * * * *